US006165565A

United States Patent [19]

Schelhorn et al.

[11] Patent Number: 6,165,565

[45] **Date of Patent: *Dec. 26, 2000**

[54] METHOD FOR CORONA TREATING THERMOSETS

[75] Inventors: Jean E. Schelhorn, Granville; Thomas K. Thompson, Newark, both of Ohio

[73] Assignee: Owens Corning Fiberglas Technology, Inc., Summit, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/598,067

[22] Filed: Feb. 7, 1996

Related U.S. Application Data

[63] Continuation of application No. 08/372,255, Jan. 13, 1995, abandoned.

[51] Int. Cl.[7] ..... H05H 1/00

[52] U.S. Cl. ..... 427/536; 427/488; 427/493

[58] Field of Search ..... 427/536, 535, 427/488, 493

[56] References Cited

U.S. PATENT DOCUMENTS

| | | | |
|---|---|---|---|
| 4,084,020 | 4/1978 | Mathias et al. | 427/488 |
| 4,252,696 | 2/1981 | McQuarrie | 260/16 |
| 4,468,412 | 8/1984 | Fuji et al. | 427/536 |
| 4,640,065 | 2/1987 | Harris et al. . | |
| 4,681,722 | 7/1987 | Carter et al. | 264/171 |
| 4,717,516 | 1/1988 | Isaka et al. | 264/22 |
| 4,938,823 | 7/1990 | Balazek et al. . | |
| 4,995,213 | 2/1991 | Bezubic | 52/656 |
| 5,026,463 | 6/1991 | Dinter et al. | 204/164 |
| 5,350,603 | 9/1994 | McFarland et al. | 427/470 |
| 5,445,854 | 8/1995 | Newsham et al. | 427/488 |
| 5,609,806 | 3/1997 | Walsh | 264/136 |

FOREIGN PATENT DOCUMENTS 63-060738 3/1988 Japan .

OTHER PUBLICATIONS

Corotec Plasma–Jet Series Surface Treatment Equipment, "Installation, Operation, and Precedures Manual", Corotec Corporation, No date or pages given.

"Frequency Effects On Corona Discharge Treatment", Bruce D. Stobbe, Corotec Corporation, No date or page numbers given.

"The Basics Of Surface Treatment By Corona Discharge", Bruce D. Stobbe, Corotec Corporation, No date or page numbers available.

Schut, Jan H., Plastics Technology, "Corona Sparks New Interest For Treating Large 3–D Parts", Feb. 1993, pp. 58–61.

Schut, Jan, H., Plastics Technology, "Plasma Treatment", Oct. 1992, pp. 64–68.

*Primary Examiner*—Shrive Beck
*Assistant Examiner*—Bret Chen
*Attorney, Agent, or Firm*—Inger H. Eckert; Anthony R. Chi

[57] ABSTRACT

This development is a method for accelerating thermoset resin cure and enhancing adhesions of coatings to thermoset articles comprising the steps of providing a thermoset article having at least one surface and corona treating the thermoset article to increase the surface energy thereof. The corona treating allows for painting in line with the pultrusion process for producing thermoset articles.

10 Claims, 2 Drawing Sheets

METHOD FOR CORONA TREATING THERMOSETS

This is a continuation of applicants' earlier filed application Ser. No. 08/372,255, filed Jan. 13, 1995 now abandoned.

TECHNICAL FIELD

This invention relates to a method for corona treating a thermoset article to increase the polarity of the surface thereof More particularly, continuously advancing elongate members are so treated to accelerate paint cure and enhance paint adhesion.

BACKGROUND OF THE INVENTION

Applying a coating, such as paint, to all or part of an elongate member, such as an FRP pultruded lineal used to fabricate windows, continues to require improvement. When the elongate member is pultruded, advantages exist in coating contemporaneously or in-line with the pultrusion process. Painting in-line, however requires coordinating a multitude of variables. The process must coordinate painting steps with pultrusion steps. Painting in-line in particular requires addressing paint adhesion to the continuously advancing article. This is especially true where the article comprises a thermoset resin.

DISCLOSURE OF INVETION

We now have developed a method for accelerating cure and enhancing adhesion of coatings to thermoset articles comprising the steps of providing a thermoset article having at least one surface and corona treating the thermoset article to increase the polarity of the surface thereof. The corona treating oxidizes the surface of the thermoset article. The treated surface is thereby more polar and has a higher surface energy level. The corona treating also forms mechanical sites on the surface which further aids adhesion of the coatings thereto. Preferably, the articles is an advancing elongate member and the corona treating is applied continuously. Our method preferably includes the step of coating the surface of the article after the corona treating. Typically, the thermoset article is a polyester and the coating is a two part acrylic modified urethane which can be solvent diluted.

BEST MODE OF CARRYING OUT THE INVENTION

Figure 1:
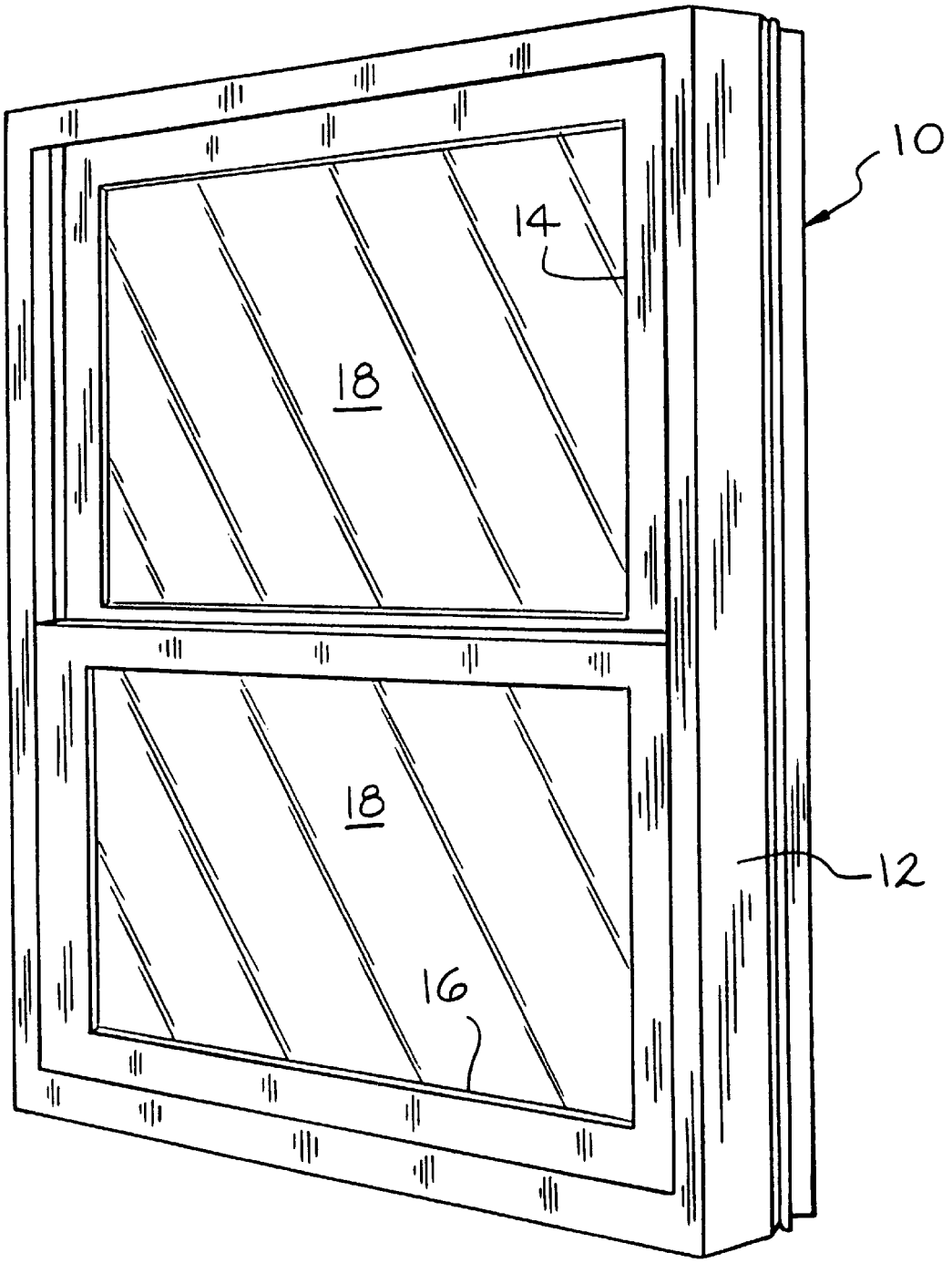
FIG. 1 is a view of a double-hung window frame and sash constructed of fibrous glass structural members.

FIG. 1 illustrates a double-hung window 10 including a frame 12 and upper and lower window sashes 14 and 16 constructed of lineal structural members. Each of frame 12 and sashes 14 and 16 has straight top, bottom and opposite side members. Each sash 14 and 16 is shown with an insulating glass unit 18, although removable double glazing may be used instead.

Figure 2:
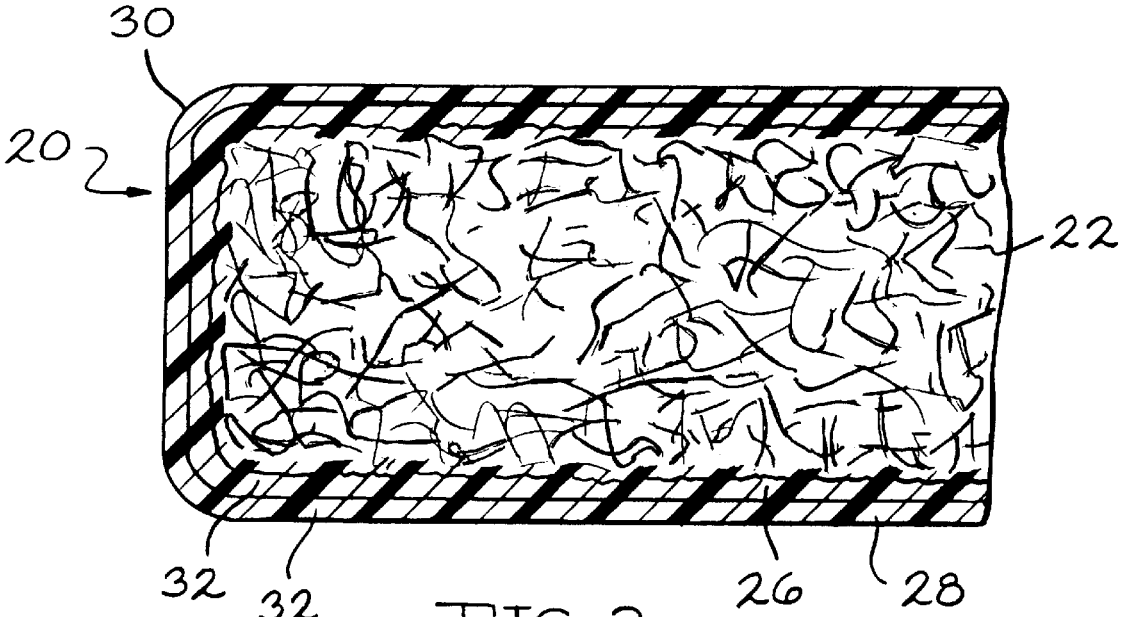
FIG. 2 is an enlarged view of a shaped fibrous glass structural member.

FIG. 2 shows shaped fibrous glass structural member 20. Core 22 for a structural member 20 is a glass fiber board including glass wool impregnated with about 20% or less, suitably 14% by weight of a phenolic resin binder such as phenol-urea-formaldehyde and molded and cured to a density of less than 20 pounds per cubic foot, suitably 6 to 8 pounds per cubic foot, and to an appropriate thickness. The board is appropriately grooved at opposite ends and slip into core 22 of appropriate rectangular cross-section. A casing encases core 22 and comprises mats 26 and 28 and rovings 30 impregnated with resin 32. The casing provides a cover around core 22 having a high quality, void-free surface finish that is reinforced. Generally, mat 28 is a polyester veil, mat 26 is a continuous glass strand mat and resin 32 is a polyester resin. Mat 28 may be a conductive veil capable of being grounded.

Structural member 20 may be made by any continuous process such as by pultrusion. A preferred method and apparatus for producing the continuous elongate member is that U.S. Pat. No. 4,681,722 discloses.

The thermoset polymers solidify or set irreversibly when heated. Thermoset usually means a cross-linking reaction of the molecular constituents induced by heat or radiation. In many cases, one needs to add "curing" agents such as organic peroxides or (in the case of rubber) sulfur. For example, linear polyethylene cross-links to a thermosetting material either by radiation or by chemical reaction. Phenolics, alkyds, amino resins, polyesters, epoxides and silicones are thermosetting; but the term also applies to materials where additive-induced cross-linking is possible, e.g. natural rubber.

Use of corona treatment enhances adhesion of protective and decorative surface treatments on thermoset parts, achieves higher cure levels and eliminates the need for primers or abrasives in conjunction with thermoset parts coating. Corona treatment increases adhesion of coatings/tie layer adhesives to thermosets without need for primers or abrasives. The treating also increases the cure level of thermoset parts.

Prior to investigations of corona treatment strategies, thermoset lineals had been surface prepped with a commercial power blaster at a cost penalty. Corona treatment is a methodology whereby atmospheric ionized gases are directed onto a surface. The chemical species on the surface are oxidized by reaction with the generated ion rich corona plume and some mechanical surface alteration also takes place. The oxidized surface species are polar and thus the surface now has higher surface energy. This allows materials such as paints to adhere to this treated surface through strong Van der Waals' attraction to the polar species and some mechanical sites formed in the process. Use of corona treatment allows parts to be painted or coated without abrasive treatment or priming and at very low surface treatment cost.

We investigated corona treatment on a thermoset system in conjunction with liquid paints, powder paints, moisture-cure hot melt adhesives and thermoplastic coatings. We saw improved adhesion for all systems; the need for alternative mechanical surface prep was eliminated. Since our surface is a filled free radical initiated polyester resin, we also documented a increase in resin cure level achieved by corona treatment. This stems from interaction of the resin with free radicals (ions) from the corona plume which essentially increase the concentration of free radicals which force further polymer cure. The free radical or ions at the surface propagate through standard mechanisms into the resin. Corona treatment of thermosets is enabling technology for in-line painting processes. It is applicable to all pultrusion processes requiring protective or decorative surface finishes.

The paint we prefer is a two part acrylic modified urethane which can be solvent diluted.

Conventional paints and stains which also can be used for coating include the following: phenolic, urethane, epoxy, acrylic cationic latex, acrylic anionic latex, water-reducible polyester, thermoplastic and latexes. We also can use powder coating techniques, as well as transparent or translucent stains.

EXAMPLE

Corona treatments have been found effective using a wide range of equipment. Most work has been done using a corona field generated with 60 Hz and 30 K electrode volts, but is equally effective with fields generated over a range of frequencies and voltages, such as, 2 M Hz and 20K–250 K volts, Hz to 30 K Hz and 30 K volts.

As an example, a paint adhesion run was made on a thermoset polyester resin lineal, using a 60 Hz, 30 K volt corona unit. The corona plume was applied at two different locations having lineal temperatures of 265° F. and 145° with a lineal speed of 5 FPM. Adhesion was measured separately for each temperature and line location. The control for both temperatures was 0 to 1 or no paint adhesion. After corona treatment, adhesion was 4 to 5. Paint adhesion was measured using the industry standard cross hatch method and a two part acrylic modified urethane paint system. No adhesion has a value of zero and complete adhesion has a value of 5. Acceptable adhesion is 3 or higher.

A second example looked at the effect of corona treatment on accelerating resin cure. Under this condition the corona plume was applied to the window lineal under the conditions above and discharge end of the forming die. Without the corona unit, the control gave a DMA7 cure index of 13.8. The index was 5.3, with the corona on. The acceptable range is a maximum of 12 and a preferred range of 6 to 7 or less.

What is claimed is:

1. An in-line method of treating a surface of a thermoset article, comprising:

forming at a first station a thermoset article by discharging a material comprising polyester resin through a forming die and curing the material;

further curing the thermoset article at a second station after the forming die with free radicals from a corona plume to form a corona-treated surface; and applying a coating of paint to the corona-treated surface.

2. A method as defined in claim 1, wherein said article is an elongate member.

3. A method as defined in claim 1, wherein said article is a window lineal.

4. A method as defined in claim 1, wherein said paint is an acrylic-modified urethane paint.

5. A method as defined 1, wherein said forming comprises pultruding an elongate member through said die to form said surface composed of said material.

6. A method as defined in claim 5, wherein said elongate member comprises (a) a board comprising glass fiber and (b) a casing surrounding said board and comprising at least one mat and the polyester resin.

7. A method as defined in claim 1, wherein said corona plume is applied using a 60 Hz, 30 Kvolt corona unit.

8. A method as defined in claim 7, wherein said article is a lineal, said corona plume is applied at a lineal temperature of about 145–265° F. and a lineal speed of about 5 feet per minute, and said first station is in-line with said second station.

9. A method as defined in claim 8, wherein said paint is an acrylic-modified urethane paint.

10. A method as defined in claim 1, wherein said first station is in-line with said second station.

* * * * *